US010657911B2

(12) United States Patent
Hao

(10) Patent No.: US 10,657,911 B2
(45) Date of Patent: May 19, 2020

(54) VERTICAL ALIGNMENT LIQUID CRYSTAL DISPLAY

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventor: Sikun Hao, Guangdong (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/112,457

(22) Filed: Aug. 24, 2018

(65) Prior Publication Data

US 2019/0304384 A1 Oct. 3, 2019

Related U.S. Application Data

(63) Continuation of application No. PCT/CN2018/092352, filed on Jun. 22, 2018.

(30) Foreign Application Priority Data

Apr. 2, 2018 (CN) ..... 2018 1 0284064

(51) Int. Cl.
*G09G 3/36* (2006.01)

(52) U.S. Cl.
CPC ..... *G09G 3/3607* (2013.01); *G09G 3/3648* (2013.01); *G09G 2300/0447* (2013.01);
(Continued)

(58) Field of Classification Search
CPC ..... G09G 2300/0447; G09G 2320/028; G09G 2320/066; G09G 2320/068
See application file for complete search history.

(56) References Cited

U.S. PATENT DOCUMENTS

2008/0186304 A1* 8/2008 You ..... G09G 3/3659 345/212
2008/0303768 A1* 12/2008 Do ..... G09G 3/3659 345/90

(Continued)

FOREIGN PATENT DOCUMENTS

CN 102566177 A 7/2012

*Primary Examiner* — Dong Hui Liang
(74) *Attorney, Agent, or Firm* — Leong C. Lei

(57) ABSTRACT

Provided is a vertical alignment liquid crystal display, comprising a plurality of data lines and a plurality of scan lines, wherein the data lines and the scan lines intersect to form a plurality of pixel regions, and each pixel region is surrounded by two adjacent data lines and two adjacent scan lines; wherein each pixel region comprises a switching thin film transistor and a sub pixel, and a gate and a drain of the switching thin film transistor are respectively connected to the scan line and the data line, and a source of the switching thin film transistor is connected to the sub pixel; in two adjacent pixel regions in the same row, a first capacitor is connected in series between the sources of the two switching thin film transistors, and the source of each of the switching thin film transistors is connected to only one of the first capacitors.

20 Claims, 6 Drawing Sheets

(52) U.S. Cl.
CPC ..... *G09G 2300/0804* (2013.01); *G09G 2310/0251* (2013.01); *G09G 2310/06* (2013.01); *G09G 2320/028* (2013.01); *G09G 2320/0233* (2013.01); *G09G 2320/0242* (2013.01); *G09G 2320/066* (2013.01)

(56) References Cited

U.S. PATENT DOCUMENTS

2009/0310047 A1* 12/2009 Shin ..... G09G 3/3659 349/37
2010/0066658 A1* 3/2010 Kim ..... G09G 3/3659 345/98
2010/0182523 A1* 7/2010 Woo ..... G02F 1/134363 349/37
2011/0221988 A1* 9/2011 Cho ..... G02F 1/134363 349/41
2012/0236222 A1* 9/2012 Kim ..... G09G 3/3659 349/41

* cited by examiner

VERTICAL ALIGNMENT LIQUID CRYSTAL DISPLAY

CROSS-REFERENCE TO RELATED APPLICATION

This application is a continuing application of PCT Patent Application No. PCT/CN2018/092352 entitled "Vertical alignment liquid crystal display", filed on Jun. 22, 2018, which claims priority to Chinese Patent Application No. 201810284064.7, filed on Apr. 2, 2018, both of which are hereby incorporated in its entireties by reference.

FIELD OF THE INVENTION

The present invention relates to a display field, and more particularly to a vertical alignment liquid crystal display.

BACKGROUND OF THE INVENTION

Liquid crystal display is one of the most widely used flat panel displays, and has gradually become widely used in various electronic devices, such as mobile phones, personal digital assistants (PDAs), digital cameras, computer screens or laptop screens, which has a display with a high resolution color screen. The current liquid crystal displays usually have an upper substrate, a lower substrate and an intermediate liquid crystal layer, and the substrate is composed of glass and electrodes. In case that both the upper substrate and lower substrate have electrodes, a vertical electric field mode display, such as a TN (Twist Nematic) mode, a VA (Vertical Alignment) mode can be developed and an MVA (Multi-domain Vertical Alignment mode) to solve the narrow viewing angle can be developed. In another type, unlike the above display, the electrodes are located only on one side of the substrate to form a display of a transverse electric field mode, such as an IPS (In-plane switching) mode and an FFS (Fringe Field Switching) mode. Compared with cathode ray tube displays, the Thin Film Transistor Liquid Crystal Display (TFT-LCD) has a relatively narrow viewing angle, which brings great limitations for the application in high-end display fields, where the viewing angle is critical, such as aerospace, medical and other fields. With the rapid development of wide viewing angle technology in the LCD field, the viewing angles of many products have been able to achieve horizontal viewing angles and vertical viewing angles of 85 degrees/85 degrees, and even to achieve larger viewing angles.

LCD wide viewing angle technology currently mainly includes Multi-domain Vertical Alignment technology and In Plane Switching (IPS) technology. The advantage of the vertical alignment mode is that the front contrast is high, usually up to 4000:1 and above; the IPS technology rotates the liquid crystal molecules under action of the horizontal electric field by forming pixel electrodes and common electrodes which are parallel and repeatedly distributed on the TFT (thin film transistor) array substrate to form a wide viewing angle. However, the contrast is relatively low, generally below 2000:1.

FIG. 1 shows a diagram of a driving circuit of a liquid crystal display according to the prior art. In the driving circuit, the data lines are distributed in the vertical direction, and the scan lines are distributed in the horizontal direction, Each sub pixel corresponds to one data line and one scan line, and the red sub pixel, the green sub pixel and the blue sub pixel are spaced apart in the horizontal direction. In FIG. 1, DR1, DG1 and DB1 respectively represent data lines corresponding to the first column of red sub pixels, the first column of green sub pixels and the first column of blue sub pixels, and DRn, DGn and DBn respectively represent the nth column of red sub pixels, the nth column of green sub pixels and the nth column of blue sub pixels; G1 . . . Gn represents the scan lines.

FIG. 2 shows gamma curves of a vertical alignment liquid crystal display provided by the present invention at different viewing angles. The bottom curve is the gamma curve corresponding to the 0 degree view angle, and the top curve is the gamma curve corresponding to the 70 degrees view angle. The gamma curves corresponding to the 10 degrees view angle, the 20 degrees view angle, the 30 degrees view angle, the 40 degrees view angle, the 50 degrees view angle, and the 60 degrees view angle are sequentially arranged from bottom to top between the foregoing two gamma curves. It can be seen that the large-angle gamma curve of the middle and low gray scales rises, and the gamma curve of the high gray scale sinks, and meanwhile the transmittances of the liquid crystal display corresponding to the 10 degrees view angle to the 70 degrees view angle are greater than the transmittance corresponding to the 0 degree view angle under the same gray level, resulting in that the color deviations of the liquid crystal display corresponding to the 10 degrees view angle to the 70 degrees view angle are greater than the color deviations corresponding to the 0 degree view angle. The liquid crystal display based on the above pixel design has poor viewing angle characteristics, which affects the display quality. The corresponding liquid crystal display has a contrast reduction for a large viewing angle (for example, a viewing angle of 70°), and the color seems like to be washed away by water.

SUMMARY OF THE INVENTION

For solving the aforesaid issues, the present invention provides a vertical alignment liquid crystal display, capable of improving the disadvantages such as the view angle color deviation and the contrast reduction of the liquid crystal display.

The present invention provides a vertical alignment liquid crystal display, comprising a plurality of data lines and a plurality of scan lines, wherein the plurality of data lines and the plurality of scan lines intersect to form a plurality of pixel regions, and each pixel region is surrounded by two adjacent data lines and two adjacent scan lines;

wherein each pixel region comprises a switching thin film transistor and a sub pixel, and a gate and a drain of the switching thin film transistor are respectively connected to the scan line and the data line, and a source of the switching thin film transistor is connected to the sub pixel;

in two adjacent pixel regions in the same row, a first capacitor is connected in series between the sources of the two switching thin film transistors, and the source of each of the switching thin film transistors is connected to only one of the first capacitors.

Preferably, the switching thin film transistors in the same row of the pixel regions are commonly driven by the scan lines on both sides of the row of pixel regions.

Preferably, the gates of two adjacent switching thin film transistors in the same pixel regions are respectively connected to the scan lines on the both sides of the row of pixel regions.

Preferably, the switching thin film transistors in the same pixel regions and located in an odd-numbered column pixel regions are connected on the same scan line, and the switching thin film transistors in the same pixel regions and located in an even-numbered column pixel regions are also connected to the same scan line.

Preferably, the drains of the switching thin film transistors of the same column are connected to the same data line, and the plurality of switching thin film transistors in the same row of pixel regions are respectively connected to different data lines.

Preferably, the sub pixel comprises a liquid crystal capacitor, and the liquid crystal capacitor comprises a pixel electrode and a common electrode disposed opposite to each other, and the source of the switching thin film transistor is connected to the pixel electrode.

Preferably, the sub pixels in each row of pixel regions are one of red sub pixels, green sub pixels and blue sub pixels.

Preferably, as the liquid crystal display is in operation, the plurality of data lines are used to access data signals of the same waveform, or some of the plurality of data lines are used to access data signals of the same waveform, and other data lines are used to access data signals of opposite waveforms.

The present invention further provides a vertical alignment liquid crystal display, comprising a plurality of data lines and a plurality of scan lines, wherein the plurality of data lines and the plurality of scan lines intersect to form a plurality of pixel regions, and each pixel region is surrounded by two adjacent data lines and two adjacent scan lines;

wherein each pixel region comprises a switching thin film transistor and a sub pixel, and a gate and a drain of the switching thin film transistor are respectively connected to the scan line and the data line, and a source of the switching thin film transistor is connected to the sub pixel;

in two adjacent pixel regions in the same row, a first capacitor is connected in series between the sources of the two switching thin film transistors, and the source of each of the switching thin film transistors is connected to only one of the first capacitors;

wherein the switching thin film transistors in the same row of the pixel regions are commonly driven by the scan lines on both sides of the row of pixel regions;

wherein the drains of the switching thin film transistors of the same column are connected to the same data line, and the plurality of switching thin film transistors in the same row of pixel regions are respectively connected to different data lines.

Preferably, the gates of two adjacent switching thin film transistors in the same pixel regions are respectively connected to the scan lines on the both sides of the row of pixel regions.

Preferably, the switching thin film transistors in the same pixel regions and located in an odd-numbered column pixel regions are connected on the same scan line, and the switching thin film transistors in the same pixel regions and located in an even-numbered column pixel regions are also connected to the same scan line.

Preferably, the sub pixel comprises a liquid crystal capacitor, and the liquid crystal capacitor comprises a pixel electrode and a common electrode disposed opposite to each other, and the source of the switching thin film transistor is connected to the pixel electrode.

Preferably, the sub pixels in each row of pixel regions are one of red sub pixels, green sub pixels and blue sub pixels.

Preferably, as the liquid crystal display is in operation, the plurality of data lines are used to access data signals of the same waveform, or some of the plurality of data lines are used to access data signals of the same waveform, and other data lines are used to access data signals of opposite waveforms.

The present invention further provides a vertical alignment liquid crystal display, comprising a plurality of data lines and a plurality of scan lines, wherein the plurality of data lines and the plurality of scan lines intersect to form a plurality of pixel regions, and each pixel region is surrounded by two adjacent data lines and two adjacent scan lines;

wherein each pixel region comprises a switching thin film transistor and a sub pixel, and a gate and a drain of the switching thin film transistor are respectively connected to the scan line and the data line, and a source of the switching thin film transistor is connected to the sub pixel;

in two adjacent pixel regions in the same row, a first capacitor is connected in series between the sources of the two switching thin film transistors, and the source of each of the switching thin film transistors is connected to only one of the first capacitors;

wherein the drains of the switching thin film transistors of the same column are connected to the same data line, and the plurality of switching thin film transistors in the same row of pixel regions are respectively connected to different data lines;

wherein the sub pixel comprises a liquid crystal capacitor, and the liquid crystal capacitor comprises a pixel electrode and a common electrode disposed opposite to each other, and the source of the switching thin film transistor is connected to the pixel electrode.

Preferably, the switching thin film transistors in the same row of the pixel regions are commonly driven by the scan lines on both sides of the row of pixel regions.

Preferably, the gates of two adjacent switching thin film transistors in the same pixel regions are respectively connected to the scan lines on the both sides of the row of pixel regions.

Preferably, the switching thin film transistors in the same pixel regions and located in an odd-numbered column pixel regions are connected on the same scan line, and the switching thin film transistors in the same pixel regions and located in an even-numbered column pixel regions are also connected to the same scan line.

Preferably, the sub pixels in each row of pixel regions are one of red sub pixels, green sub pixels and blue sub pixels.

Preferably, as the liquid crystal display is in operation, the plurality of data lines are used to access data signals of the same waveform, or some of the plurality of data lines are used to access data signals of the same waveform, and other data lines are used to access data signals of opposite waveforms.

The implementation of the present invention possesses results: in the present invention, a first capacitor is connected in series between the switching thin film transistors in the same row and two adjacent pixel regions. After charging the previous sub pixel in the adjacent two pixel regions is completed, and then charging the next sub pixel, the driving voltage of the previous sub pixel can be increased with the first capacitor, so that one of the sub pixels in the two adjacent pixel regions is driven by the high driving voltage, and the other is driven by the low drive voltage. The pixel region corresponding to the sub pixel with the high driving voltage is used as the main pixel region, and the pixel region corresponding to the sub pixel with the low driving voltage is used as the sub pixel region. The plurality of main pixel regions and the plurality of sub pixel regions are spaced apart from each other.

The driving voltage of the sub pixel in the main pixel region is greater than the driving voltage of the sub pixel in the sub pixel region, that is, the luminance of the sub pixel in the main pixel region is greater than the luminance of the sub pixel in the sub pixel region. Meanwhile, the main pixel region and the sub pixel region are spaced apart from each other. The luminance of the main pixel region and the luminance of the sub pixel region are mutually neutralized, which can reduce the view angle color deviation of the vertical alignment liquid crystal display, particularly some large view angle color deviation, such as a 70-degrees viewing angle, and can improve the disadvantage of the contrast reduction of the liquid crystal display.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Figure 1:
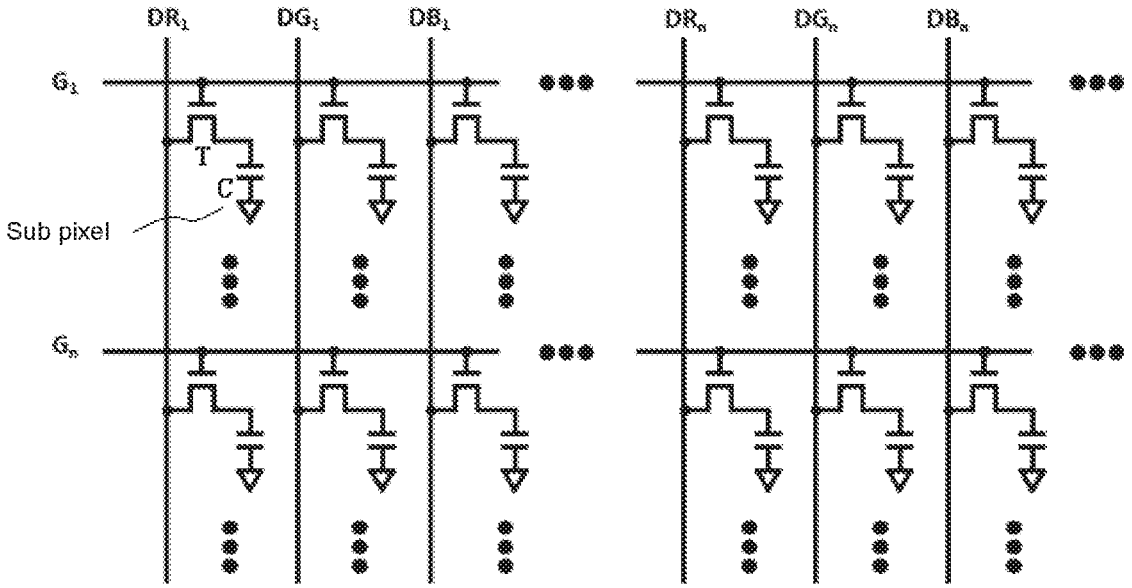
FIG. 1 is a diagram of a driving circuit of a liquid crystal display according to the prior art.
Figure 2:
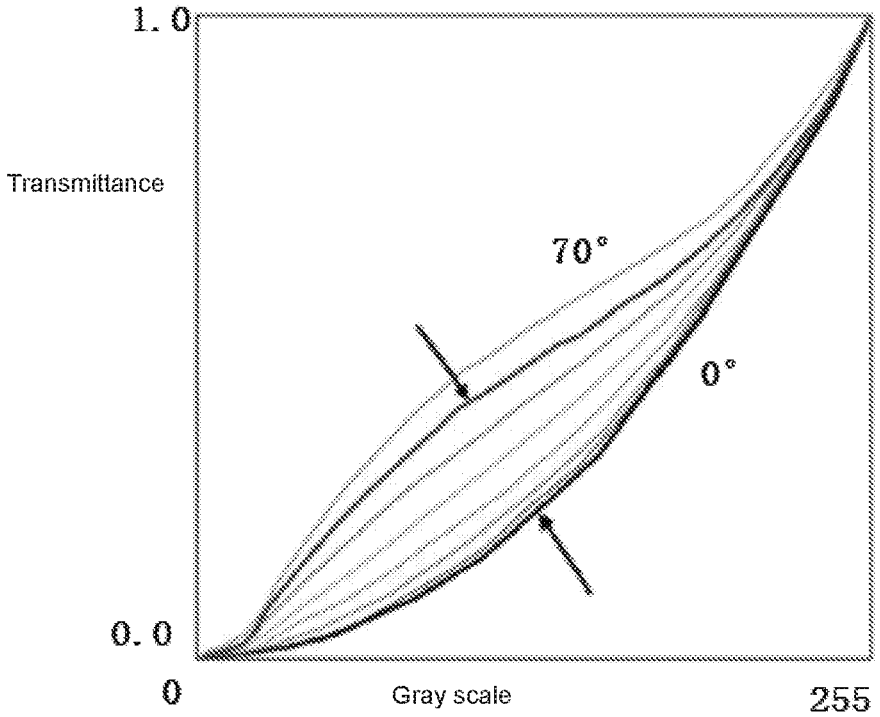
FIG. 2 is a gamma curve diagram of a vertical alignment liquid crystal display provided by the present invention at different viewing angles.
Figure 3:
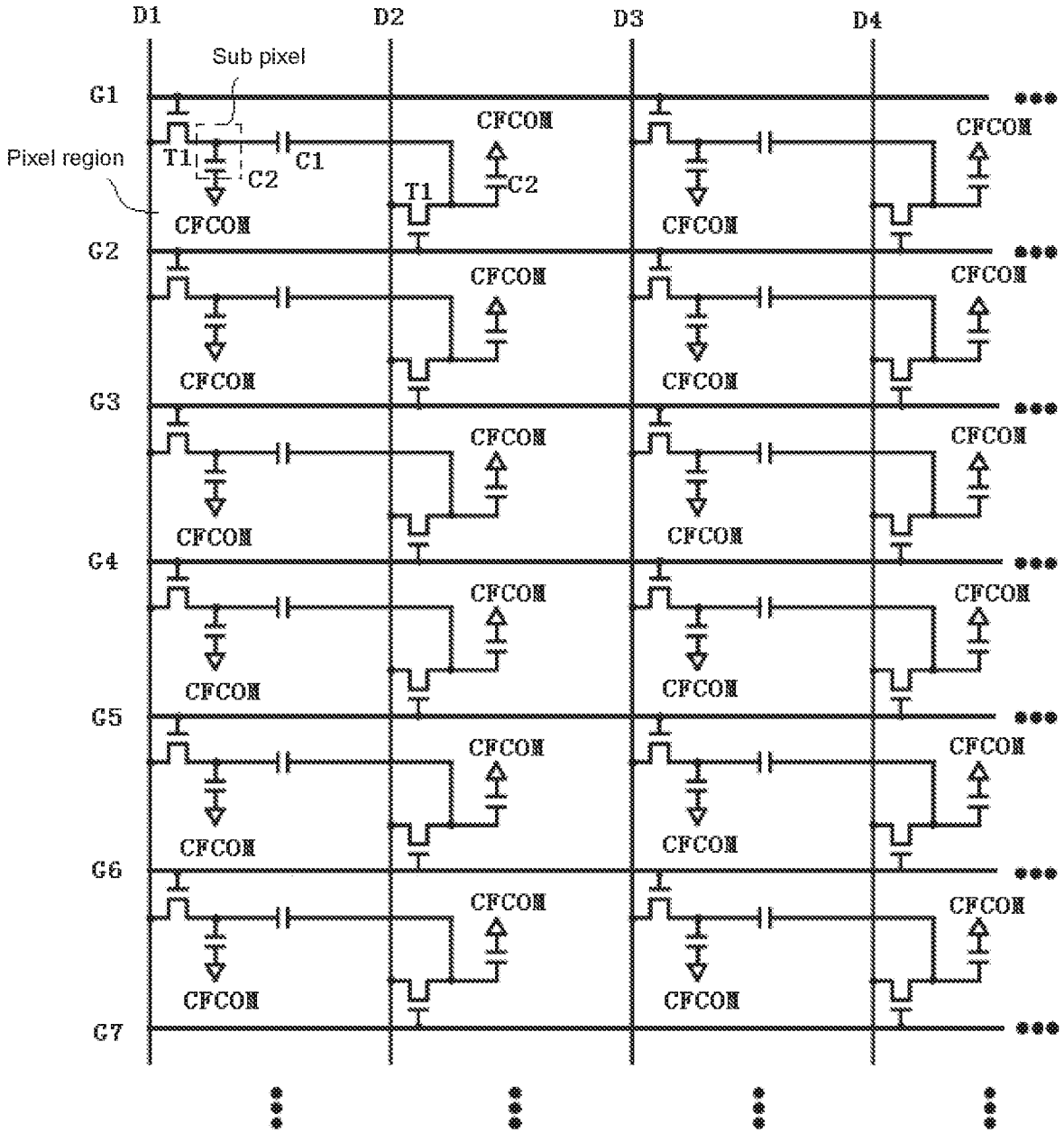
FIG. 3 is a diagram of a driving circuit of a vertical alignment liquid crystal display provided by the present invention.

The present invention provides a vertical alignment liquid crystal display as shown in FIG. 3. The liquid crystal display comprises a plurality of data lines D1, D2, D3, D4, . . . and a plurality of scan lines G1, G2, G7 . . . , wherein the plurality of data lines and the plurality of scan lines intersect to form a plurality of pixel regions, and each pixel region is surrounded by two adjacent data lines and two adjacent scan lines. For instance, the data lines D1, D2 and the scan lines G1, G2 surround one pixel region.

Each pixel region comprises a switching thin film transistor T1 and a sub pixel, and a gate and a drain of the switching thin film transistor T1 are respectively connected to the scan line and the data line, and a source of the switching thin film transistor T1 is connected to the sub pixel. When the scan signal on the scan line turns on the switching thin film transistor, the data signal on the data line is output to the sub pixel to drive the sub pixel to emit light.

In two adjacent pixel regions in the same row, a first capacitor C1 is connected in series between the sources of the two switching thin film transistors T1, and the source of each of the switching thin film transistors T1 is connected to only one of the first capacitors C1.

For instance, a first capacitor C1 is connected in series between the source of the switching thin film transistor T1 of the first row, the first column and the source of the switching thin film transistor T1 of the first row, the second column. A first capacitor C1 is connected in series between the source of the switching thin film transistor T1 of the first row, the nth column and the source of the switching thin film transistor T1 of the first row, the n+1th column, and n is an odd number greater than zero. In the second row of pixel regions, a first capacitor C1 is connected in series between the source of the switching thin film transistor T1 of the second row, the nth column and the source of the switching thin film transistor T1 of the second row, the n+1th column, and n may be an odd number greater than zero or an even number greater than zero.

When the liquid crystal display is in operation, at the first moment, the switching thin film transistor T1 connected to the first row of scan line G1 in the first row of pixel regions is first turned on by the first row of scan line G1, and the first column of data line D1 outputs data signals to the sub pixels through the thin film transistors T1 to charge the sub pixels, and first, the sub pixel of the first row, the first column is charged to 10V, that is, the driving voltage of the sub pixel is 10V; at the next moment, the switching thin film transistors T1 of the first row, the first column is turned off, and the switching thin film transistor T1 of the first row, the second column is turned on, and the sub pixel of the first row, the second column is charged, and i.e. also charged to 10V, and then, by using the first capacitor C1 between the switching thin film transistor T1 of the first row, the first column and the switching transistor of the first row, the second column, the driving voltage of the sub pixel of the first row, the first column can be increased, for instance, the driving voltage of sub pixel of the first row, the first column is raised to 12V. Thus, the driving voltages of the sub pixel of the first row, the first column is made different from the driving voltage of the sub pixel of the first row, the second column to form two sub pixels having a high driving voltage and a low driving voltage.

Therefore, as driving the liquid crystal display for display, the driving voltages of the sub pixels in the same row and two adjacent pixel regions are different, and the pixel region corresponding to the sub pixel with the high driving voltage is used as the main pixel region, and the pixel region corresponding to the sub pixel with the low driving voltage is used as the sub pixel region. The plurality of main pixel regions and the plurality of sub pixel regions are spaced apart from each other.

Furthermore, the switching thin film transistors T1 in the same row of the pixel regions are commonly driven by the scan lines on both sides of the row of pixel regions.

Furthermore, the gates of two adjacent switching thin film transistors T1 in the same pixel regions are respectively connected to the scan lines on the both sides of the row of pixel regions.

Furthermore, the switching thin film transistors T1 in the same pixel regions and located in an odd-numbered column pixel regions are connected on the same scan line, and the switching thin film transistors T1 in the same pixel regions and located in an even-numbered column pixel regions are also connected to the same scan line.

Furthermore, the drains of the switching thin film transistors T1 of the same column are connected to the same data line, and the plurality of switching thin film transistors in the same row of pixel regions are respectively connected to different data lines.

Furthermore, the sub pixel comprises a liquid crystal capacitor C2, and the liquid crystal capacitor C2 comprises a pixel electrode and a common electrode disposed opposite to each other, and the source of the switching thin film transistor T1 is connected to the pixel electrode. The common electrode of the liquid crystal capacitor C2 is connected to the common electrode line CFcom of the color filter substrate.

Furthermore, the sub pixels in each row of pixel regions are one of red sub pixels, green sub pixels and blue sub pixels. The adjacent three rows of pixel regions comprise the red sub pixels, the green sub pixels and the blue sub pixels.

Figure 4:
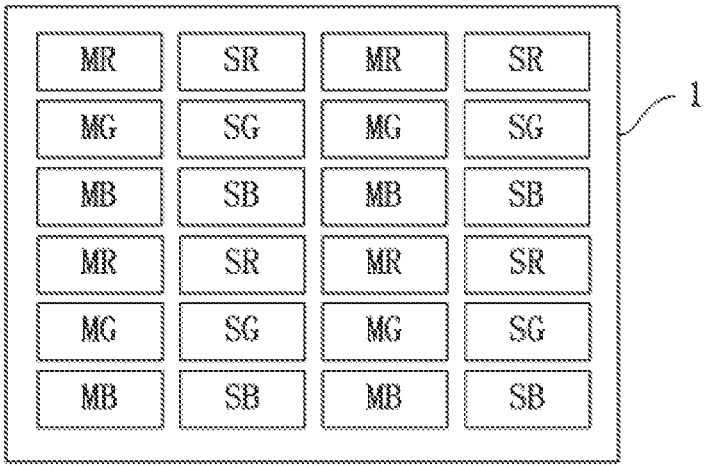
FIG. 4 is a diagram of an arrangement of various sub pixels provided by the present invention.

In one embodiment, the distribution of the red sub pixels, the green sub pixels and the blue sub pixels is as shown in FIG. 4. As shown in FIG. 4, the number 1 denotes a liquid crystal display. MR and SR respectively represent a red sub pixel of a main pixel region and a red sub pixel of a sub pixel region, and MG and SG respectively represent a green sub pixel of a main pixel region and a green sub pixel of a sub pixel region, and MB and SB respectively represent a blue sub pixel of a main pixel region and a blue sub pixel of a sub pixel region.

Figure 5:
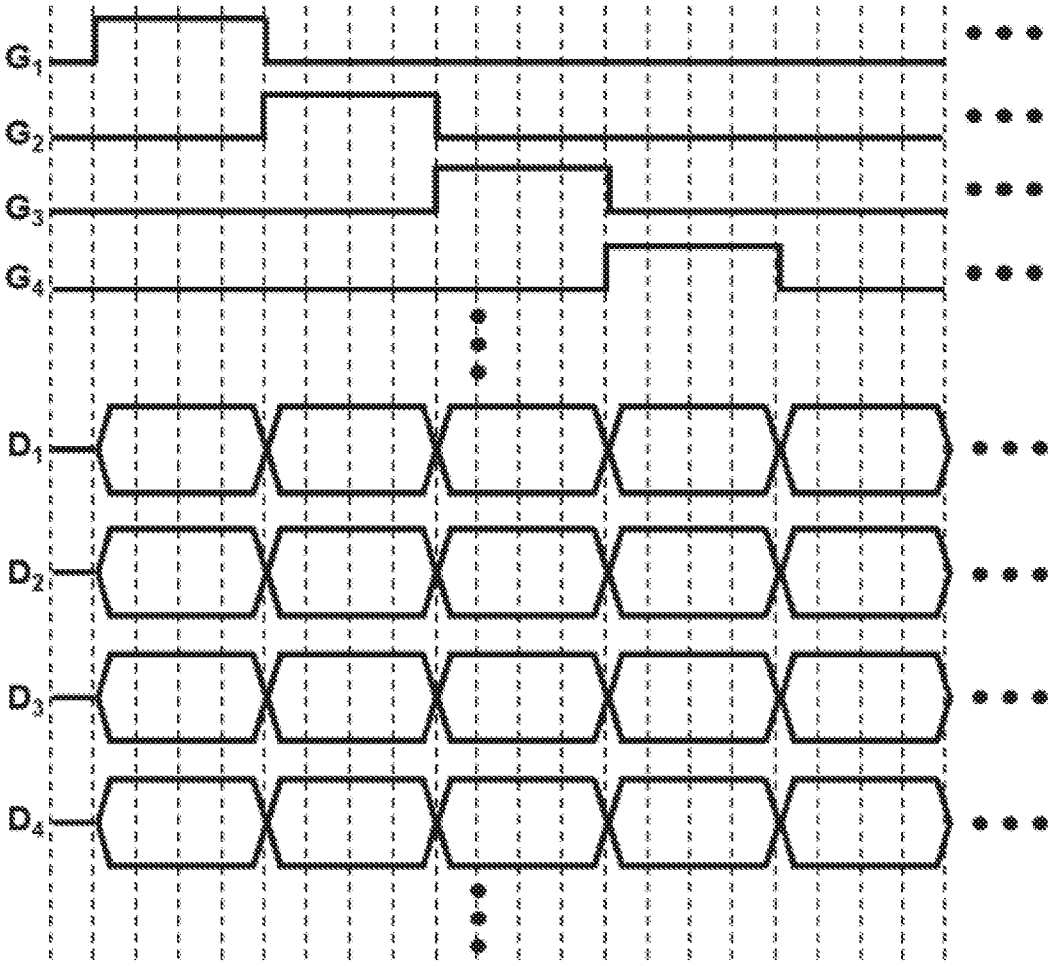
FIG. 5 is a driving sequence diagram of a vertical alignment liquid crystal display provided by the present invention.

Furthermore, as the liquid crystal display is in operation, the plurality of data lines are used to access data signals of the same waveform, or some of the plurality of data lines are used to access data signals of the same waveform, and other data lines are used to access data signals of opposite waveforms. As shown in FIG. 5, the waveforms of the data signals connected to the data lines D1, D2, D3 and D4 may be identical, or the data signals of the opposite waveforms may be respectively connected.

In conclusion, in the present invention, a first capacitor is connected in series between the switching thin film transistors in the same row and two adjacent pixel regions. After charging the previous sub pixel in the adjacent two pixel regions is completed, and then charging the next sub pixel, the driving voltage of the previous sub pixel can be increased with the first capacitor, so that one of the sub pixels in the two adjacent pixel regions is driven by the high driving voltage, and the other is driven by the low drive voltage. The pixel region corresponding to the sub pixel with the high driving voltage is used as the main pixel region, and the pixel region corresponding to the sub pixel with the low driving voltage is used as the sub pixel region. The plurality of main pixel regions and the plurality of sub pixel regions are spaced apart from each other.

The driving voltage of the sub pixel in the main pixel region is greater than the driving voltage of the sub pixel in the sub pixel region, that is, the luminance of the sub pixel in the main pixel region is greater than the luminance of the sub pixel in the sub pixel region. Meanwhile, the main pixel region and the sub pixel region are spaced apart from each other. The luminance of the main pixel region and the luminance of the sub pixel region are mutually neutralized, which can reduce the view angle color deviation of the vertical alignment liquid crystal display, particularly some large view angle color deviation, such as a 70-degrees viewing angle, and can improve the disadvantage of the contrast reduction of the liquid crystal display.

Figure 6A:
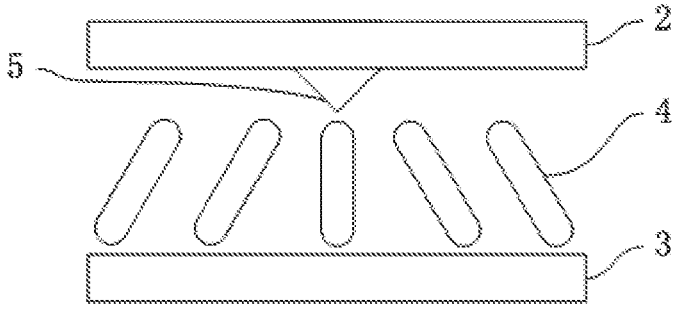
FIG. 6*a* is a diagram of liquid crystal deflection corresponding to a low driving voltage provided by the present invention.
Figure 6B:
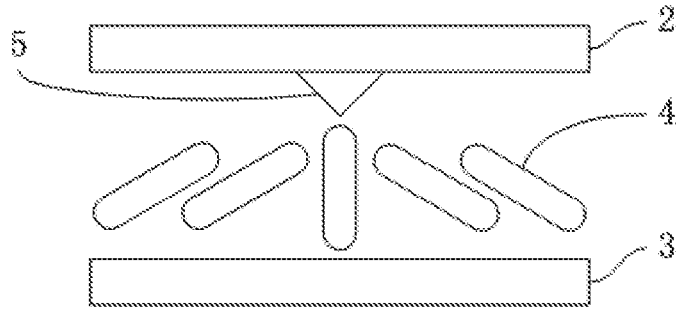
FIG. 6*b* is a diagram of liquid crystal deflection corresponding to a high driving voltage provided by the present invention.
Figure 6C:
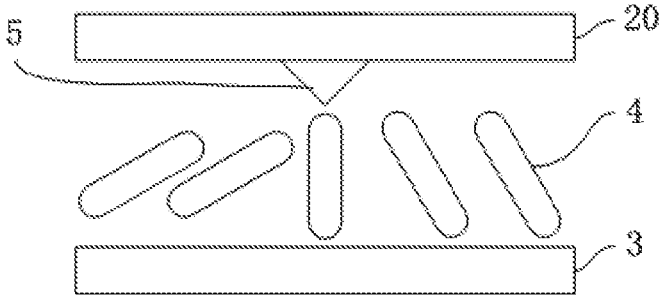
FIG. 6*c* is a diagram of liquid crystal deflection corresponding to a combination of a high driving voltage and a low driving voltage provided by the present invention.

For instance, as shown in FIGS. 6*a*, 6*b* and 6*c*, which respectively correspond to deflection angles of liquid crystal displays corresponding to a low driving voltage, a high driving voltage and a combination of a high driving voltage and a low driving voltage. 2 denotes a pixel electrode, 3 denotes a common electrode, 4 denotes a liquid crystal, 5 denotes a device for aligning the liquid crystal, and 20 denotes a pixel electrode layer. At a low driving voltage, the liquid crystal deflection angle (the angle between the liquid crystal and the vertical direction) is smaller, and at a high driving voltage, the liquid crystal deflection angle is larger.

Figure 7A:
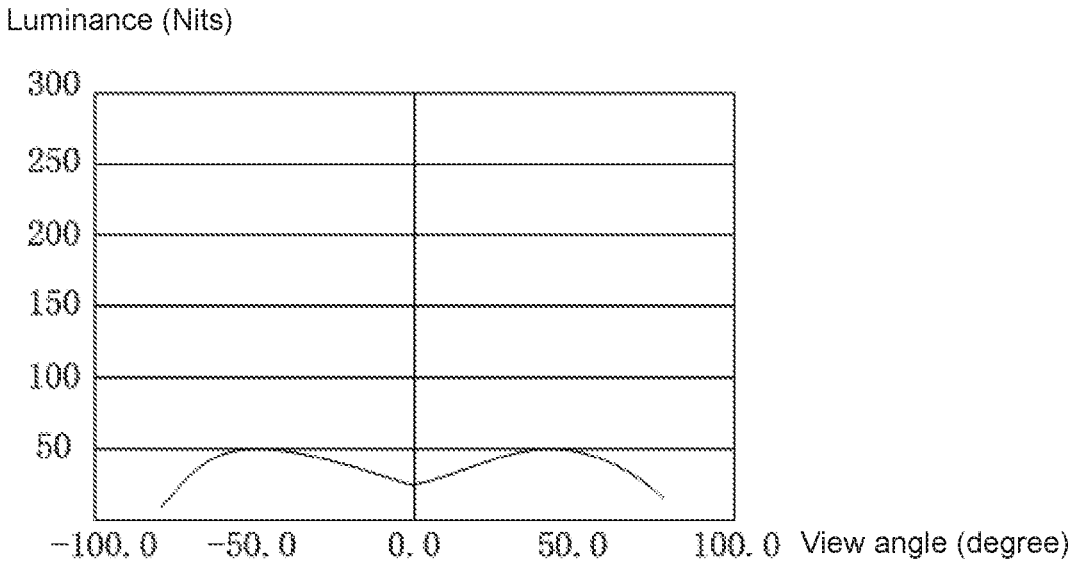
FIG. 7*a* is a graph showing a relationship between a viewing angle and a luminance of a liquid crystal display corresponding to a low driving voltage provided by the present invention.
Figure 7B:
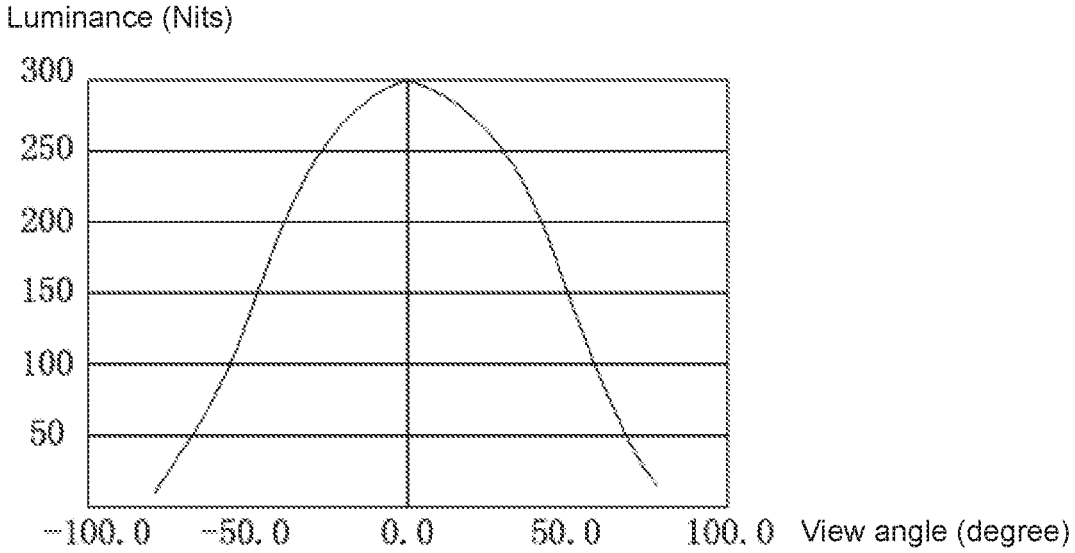
FIG. 7*b* is a graph showing a relationship between a viewing angle and a luminance of a liquid crystal display corresponding to a high driving voltage provided by the present invention.
Figure 7C:
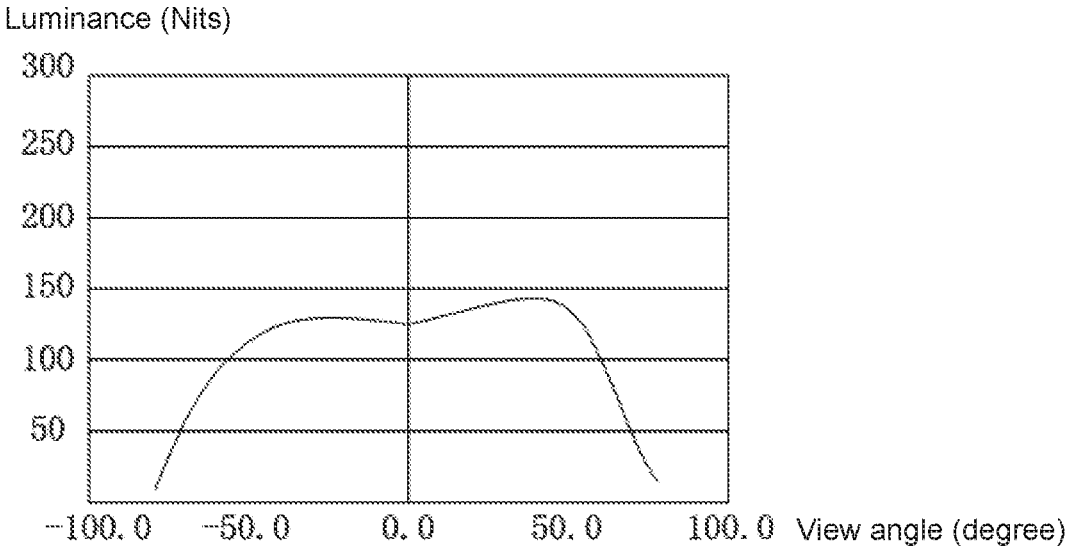
FIG. 7*c* is a graph showing a relationship between a viewing angle and a luminance of a liquid crystal display corresponding to a combination of a high driving voltage and a low driving voltage provided by the present invention.

As shown in FIGS. 7*a*, 7*b*, and 7*c*, which respectively show relationships between viewing angles and luminances of liquid crystal displays corresponding to the low driving voltage, the high driving voltage and the combination of the high driving voltage and the low driving voltage. When the liquid crystal display is driven by the method of mixing the high driving voltage and the low driving voltage of the present invention, the luminance fluctuation of the liquid crystal display in the range of the positive and negative 50 degrees of view angle is small, for instance, the luminance of the liquid crystal display at the positive or negative 50 degrees view angle is not much different from the luminance of the 0 degree view angle, so the view angle color deviation of the liquid crystal display can be improved.

Therefore, the disadvantages such as the view angle and color deviation of the liquid crystal display can be improved to promote the image display quality.

The above content with the specific preferred embodiments of the present invention is further made to the detailed description, the specific embodiments of the present invention should not be considered limited to these descriptions, Those of ordinary skill in the art for the present invention, without departing from the spirit of the present invention, can make various simple deduction or replacement, should be deemed to belong to the scope of the present invention.

What is claimed is:

1. A vertical alignment liquid crystal display, comprising a plurality of data lines and a plurality of scan lines, wherein the plurality of data lines and the plurality of scan lines intersect to form a plurality of pixel regions, and each pixel region is surrounded by two adjacent data lines and two adjacent scan lines;

wherein each pixel region comprises a switching thin film transistor and a sub pixel, and a gate and a drain of the switching thin film transistor are respectively connected to one of the two adjacent scan lines and one of the two adjacent data lines, and a source of the switching thin film transistor is connected to the sub pixel;

in two adjacent pixel regions in the same row, a first capacitor is connected in series between the sources of the two switching thin film transistors in the two adjacent pixel regions, and the source of each of the switching thin film transistors in the two adjacent pixel regions is connected to only one of the first capacitors, wherein a previous pixel region in the two adjacent pixel regions in the same row is a main pixel region, and a next pixel region in the two adjacent pixel regions in the same row is a sub pixel region, and the main pixel region is driven with a driving voltage higher than a driving voltage of driving the sub pixel region by connecting the first capacitor in series between the sources of the two switching thin film transistors in the two adjacent pixel regions.

2. The vertical alignment liquid crystal display according to claim 1, wherein the switching thin film transistors in the same row of the pixel regions are commonly driven by the scan lines on both sides of the row of pixel regions.

3. The vertical alignment liquid crystal display according to claim 2, wherein the gates of two adjacent switching thin film transistors in the same row of the pixel regions are respectively connected to the scan lines on the both sides of the row of pixel regions.

4. The vertical alignment liquid crystal display according to claim 3, wherein the switching thin film transistors in the same row of the pixel regions and located in an odd-numbered column pixel regions are connected on the same scan line, and the switching thin film transistors in the same row of the pixel regions and located in an even-numbered column pixel regions are also connected to the same scan line.

5. The vertical alignment liquid crystal display according to claim 1, wherein the drains of the switching thin film transistors of the same column are connected to the same data line, and the plurality of switching thin film transistors in the same row of pixel regions are respectively connected to different data lines.

6. The vertical alignment liquid crystal display according to claim 1, wherein the sub pixel comprises a liquid crystal capacitor, and the liquid crystal capacitor comprises a pixel electrode and a common electrode disposed opposite to each other, and the source of the switching thin film transistor is connected to the pixel electrode.

7. The vertical alignment liquid crystal display according to claim 1, wherein the sub pixels in each row of pixel regions are one of red sub pixels, green sub pixels and blue sub pixels.

8. The vertical alignment liquid crystal display according to claim 1, wherein as the liquid crystal display is in operation, the plurality of data lines are used to access data signals of the same waveform, or some of the plurality of data lines are used to access data signals of the same waveform, and other data lines are used to access data signals of opposite waveforms.

9. A vertical alignment liquid crystal display, comprising a plurality of data lines and a plurality of scan lines, wherein the plurality of data lines and the plurality of scan lines intersect to form a plurality of pixel regions, and each pixel region is surrounded by two adjacent data lines and two adjacent scan lines;

wherein each pixel region comprises a switching thin film transistor and a sub pixel, and a gate and a drain of the switching thin film transistor are respectively connected to one of the two adjacent scan lines and one of the two adjacent data lines, and a source of the switching thin film transistor is connected to the sub pixel;

in two adjacent pixel regions in the same row, a first capacitor is connected in series between the sources of the two switching thin film transistors in the two adjacent pixel regions, and the source of each of the switching thin film transistors in the two adjacent pixel regions is connected to only one of the first capacitors, wherein a previous pixel region in the two adjacent pixel regions in the same row is a main pixel region, and a next pixel region in the two adjacent pixel regions in the same row is a sub pixel region, and the main pixel region is driven with a driving voltage higher than a driving voltage of driving the sub pixel region by connecting the first capacitor in series between the sources of the two switching thin film transistors in the two adjacent pixel regions;

wherein the drains of the switching thin film transistors of the same column are connected to the same data line, and the plurality of switching thin film transistors in the same row of pixel regions are respectively connected to different data lines;

wherein the sub pixel comprises a liquid crystal capacitor, and the liquid crystal capacitor comprises a pixel electrode and a common electrode disposed opposite to each other, and the source of the switching thin film transistor is connected to the pixel electrode.

10. The vertical alignment liquid crystal display according to claim 9, wherein the switching thin film transistors in the same row of the pixel regions are commonly driven by the scan lines on both sides of the row of pixel regions.

11. The vertical alignment liquid crystal display according to claim 10, wherein the gates of two adjacent switching thin film transistors in the same row of the pixel regions are respectively connected to the scan lines on the both sides of the row of pixel regions.

12. The vertical alignment liquid crystal display according to claim 11, wherein the switching thin film transistors in the same row of the pixel regions and located in an odd-numbered column pixel regions are connected on the same scan line, and the switching thin film transistors in the same row of the pixel regions and located in an even-numbered column pixel regions are also connected to the same scan line.

13. The vertical alignment liquid crystal display according to claim 9, wherein the sub pixels in each row of pixel regions are one of red sub pixels, green sub pixels and blue sub pixels.

14. The vertical alignment liquid crystal display according to claim 9, wherein as the liquid crystal display is in operation, the plurality of data lines are used to access data signals of the same waveform, or some of the plurality of data lines are used to access data signals of the same waveform, and other data lines are used to access data signals of opposite waveforms.

15. A vertical alignment liquid crystal display, comprising a plurality of data lines and a plurality of scan lines, wherein the plurality of data lines and the plurality of scan lines intersect to form a plurality of pixel regions, and each pixel region is surrounded by two adjacent data lines and two adjacent scan lines;

wherein each pixel region comprises a switching thin film transistor and a sub pixel, and a gate and a drain of the switching thin film transistor are respectively connected to one of the two adjacent scan lines and one of the two adjacent data lines, and a source of the switching thin film transistor is connected to the sub pixel;

in two adjacent pixel regions in the same row, a first capacitor is connected in series between the sources of the two switching thin film transistors in the two adjacent pixel regions, and the source of each of the switching thin film transistors in the two adjacent pixel regions is connected to only one of the first capacitors, wherein a previous pixel region in the two adjacent pixel regions in the same row is a main pixel region, and a next pixel region in the two adjacent pixel regions in the same row is a sub pixel region, and the main pixel region is driven with a driving voltage higher than a driving voltage of driving the sub pixel region by connecting the first capacitor in series between the sources of the two switching thin film transistors in the two adjacent pixel regions;

wherein the switching thin film transistors in the same row of the pixel regions are commonly driven by the scan lines on both sides of the row of pixel regions;

wherein the drains of the switching thin film transistors of the same column are connected to the same data line, and the plurality of switching thin film transistors in the same row of pixel regions are respectively connected to different data lines.

16. The vertical alignment liquid crystal display according to claim 15, wherein the gates of two adjacent switching thin film transistors in the same row of the pixel regions are respectively connected to the scan lines on the both sides of the row of pixel regions.

17. The vertical alignment liquid crystal display according to claim 16, wherein the switching thin film transistors in the same row of the pixel regions and located in an odd-numbered column pixel regions are connected on the same scan line, and the switching thin film transistors in the same row of the pixel regions and located in an even-numbered column pixel regions are also connected to the same scan line.

18. The vertical alignment liquid crystal display according to claim 15, wherein the sub pixel comprises a liquid crystal capacitor, and the liquid crystal capacitor comprises a pixel electrode and a common electrode disposed opposite to each other, and the source of the switching thin film transistor is connected to the pixel electrode.

19. The vertical alignment liquid crystal display according to claim 15, wherein the sub pixels in each row of pixel regions are one of red sub pixels, green sub pixels and blue sub pixels.

20. The vertical alignment liquid crystal display according to claim 15, wherein as the liquid crystal display is in operation, the plurality of data lines are used to access data signals of the same waveform, or some of the plurality of data lines are used to access data signals of the same waveform, and other data lines are used to access data signals of opposite waveforms.

* * * * *